United States Patent [19]

Staas et al.

[11] 4,297,856

[45] Nov. 3, 1981

[54] $^3$He-$^4$He DILUTION REFRIGERATOR

[75] Inventors: Frans A. Staas; Willem van Haeringen; Adrianus P. Severijns, all of Eindhoven, Netherlands

[73] Assignee: U.S. Philips Corporation, New York, N.Y.

[21] Appl. No.: 128,706

[22] Filed: Mar. 10, 1980

[30] Foreign Application Priority Data

Mar. 14, 1979 [NL] Netherlands ..... 7902014

[51] Int. Cl.$^3$ ..... F25B 19/00

[52] U.S. Cl. ..... 62/514 R

[58] Field of Search ..... 62/467, 514 R

[56] References Cited

U.S. PATENT DOCUMENTS

| | | | |
|---|---|---|---|
| 3,581,512 | 6/1971 | Staas et al. | 62/514 R |
| 3,835,662 | 9/1974 | Staas et al. | 62/467 |
| 3,896,630 | 7/1975 | Severijns et al. | 62/514 R |
| 4,136,531 | 1/1979 | Staas et al. | 62/514 R |

OTHER PUBLICATIONS

Taconis et al.: *A $^4$He-$^3$He Refrigerator Through Which $^4$He is Circulated,* Physica (1971), pp. 168–170.

*An Improved Version of the $^3$He-$^4$He Refrigerator Through Which $^4$He is Circulated,* Cryogenics, vol. 14, No. 1, Jan. 1974, pp. 53–54.

*Primary Examiner*—Ronald C. Capossela

*Attorney, Agent, or Firm*—Thomas A. Briody; William J. Streeter; Rolf E. Schneider

[57] ABSTRACT

A $^3$He-$^4$He dilution refrigerator comprises an upper mixing chamber for mixing liquid concentrated $^3$He and superfluid $^4$He, and a lower segregating chamber for separating concentrated $^3$He and superfluid $^4$He. An auxiliary chamber is situated between the mixing chamber and the segregating chamber. A connecting duct extends between the segregating chamber and the auxiliary chamber. The upper part of the auxiliary chamber communicates with the upper part of the mixing chamber for flow of concentrated $^3$He into the latter; and the lower part of the auxiliary chamber communicates with the lower part of the mixing chamber for flow of dilute $^3$He to the lower part of the auxiliary chamber.

3 Claims, 2 Drawing Figures

$^3$He-$^4$He DILUTION REFRIGERATOR

This invention relates to a $^3$He-$^4$He dilution refrigerator for producing very low temperatures, comprising two chambers which are respectively situated at different levels and the upper of which forms a mixing chamber for liquid concentrated $^3$He and superfluid $^4$He, the two chambers being incorporated in a $^4$He circulation system which includes a superleak which opens into the mixing chamber for the supply of superfluid $^4$He to the mixing chamber as well as a connection duct between the two chambers which opens with its lower end near the top of the lower chamber for the supply of concentrated $^3$He to and removal of dilute $^3$He from the mixing chamber.

Dilution refrigerators of this type include refrigerators in which both $^4$He and $^3$He are circulated and refrigerators in which only $^4$He is circulated.

A dilution refrigerator with both $^3$He and $^4$He circulation is disclosed in U.S. Pat. No. 3,835,662. The superleak which opens into the mixing chamber at the higher level forms part of a fountain pump which further comprises a cooler, a capillary, a heating element and a second superleak. Superfluid $^4$He is withdrawn by the fountain pump from the evaporation reservoir and injected into the mixing chamber. The lower chamber also forms a mixing chamber in that it also forms part of a $^3$He circulation system.

A dilution refrigerator in which only $^4$He is circulated is known from the article "A $^4$He-$^3$He refrigerator through which $^4$He is circulated" (Physica, vol. 56 (1971) pp. 168–170).

The superleak which opens into the upper chamber, the mixing chamber, and which injects superfluid $^4$He into the mixing chamber communicates via a capillary with an external $^4$He gas supply system. In contrast with the above-mentioned dilution refrigerator having both $^4$He and $^3$He circulation the lower chamber of the refrigerator with only $^4$He circulation forms a segregating chamber instead of a mixing chamber.

In such known refrigerator with single circulation the $^4$He transport is realized by the supply of $^4$He gas under pressure. However, in this case it is also possible for the $^4$He circulation to use a fountain pump. This is known from the article "An improved version of the $^3$He-$^4$He refrigerator through which $^4$He is circulated" (Cryogenics, vol. 14, No. 1, January 1974, pp. 53–54).

In such known dilution refrigerators the connection duct (whether or not wound to form a spiral) which opens with its lower end near the top of the lower chamber (mixing chamber or segregating chamber) is directly connected with its upper end to the bottom of the upper chamber which always forms a mixing chamber. Through this connection duct, concentrated $^3$He flows from the lower chamber to the mixing chamber and dilute $^3$He ($^3$He dissolved in $^4$He) formed in the mixing chamber falls towards the lower chamber.

A problem in these refrigerators is the condition that a limit is imposed upon the lowest achievable temperature in the mixing chamber.

It has been found that the following relationship holds:

$$T_{min} = c \cdot \frac{d^{\frac{1}{2}}}{\dot{n}^{\frac{1}{4}}}, \text{ wherein}$$

$T_{min}$ = the minimum achievable temperature in the mixing chamber c = constant d = inside diameter of the duct connecting the two chambers $\dot{n}$ = the number of moles $^4$He which passes a cross-section per second.

In order to reach a higher $^4$He circulation so as to increase the cooling capacity, the inside diameter of the connection duct must be larger. However, this has an opposite effect with respect to the lowest achievable temperature in the mixing chamber. The cause of the limitation with respect to the lowest achievable mixing chamber temperature must be sought in an interference of the cooling process in the mixing chamber by heat leak towards said chamber. The recognition has been gained that two factors play a role.

First of all, heat is evolved by the viscous flow of the concentrated $^3$He rising in the connection duct and the drops of dilute $^3$He falling through the connection duct. In this process, the potential energy of the falling drops of dilute $^3$He is converted into heat by friction with the rising concentrated $^3$He. Secondly, a heat flow towards the mixing chamber occurs by heat conduction of the liquid in the connection duct.

It is the object of the present invention to provide an improved $^3$He-$^4$He dilution refrigerator of this type in which lower cooling temperatures in the mixing chamber can be realized both for lower and higher cooling capacities.

In order to realize the this end, the $^3$He-$^4$He dilution refrigerator according to the invention is characterized in that the connection duct opens with its upper end into an auxiliary chamber the uppermost part of which is connected to the uppermost part of the mixing chamber via a supply duct for concentrated $^3$He, while the lowermost part of the mixing chamber communicates with the lowermost part of the auxiliary chamber via an outlet duct for dilute $^3$He.

By choosing a comparatively large diameter for the outlet duct for dilute $^3$He, the viscous losses in said outlet duct are low, while by choosing a comparatively large length of the outlet duct the heat leak of the outlet duct and the auxiliary chamber, respectively, to the mixing chamber is small.

Since the connection duct opens with its upper end into the auxiliary chamber which is situated at a distance from the mixing chamber, a wide connection duct may always be chosen irrespective of the value of the $^4$He circulation speed, without the viscous losses in the connection duct adversely influencing the cooling temperature in the mixing chamber.

A favourable embodiment of the $^3$He-$^4$He dilution refrigerator according to the invention is characterized in that the inlet duct and the outlet duct are provided with one or more heat exchangers for heat exchange between concentrated $^3$He and dilute $^3$He.

This provides a further reduction of the heat flow of the connection duct and the auxiliary chamber, respectively, to the mixing chamber, which involves a further reduction of the cooling temperature in the mixing chamber.

A further favourable embodiment of the $^3$He-$^4$He dilution refrigerator according to the invention is characterized in that the heat exchangers are formed by connection ducts between the inlet duct and the outlet duct for direct heat exchange between concentrated $^3$He and dilute $^3$He.

By direct contact between concentrated $^3He$ and dilute $^3He$, the heat exchange between the two liquids is substantially ideal, which has a positive influence on the minimum cooling temperature in the mixing chamber.

The invention will now be described in greater detail with reference to the accompanying drawings, in which.

Figure 1:
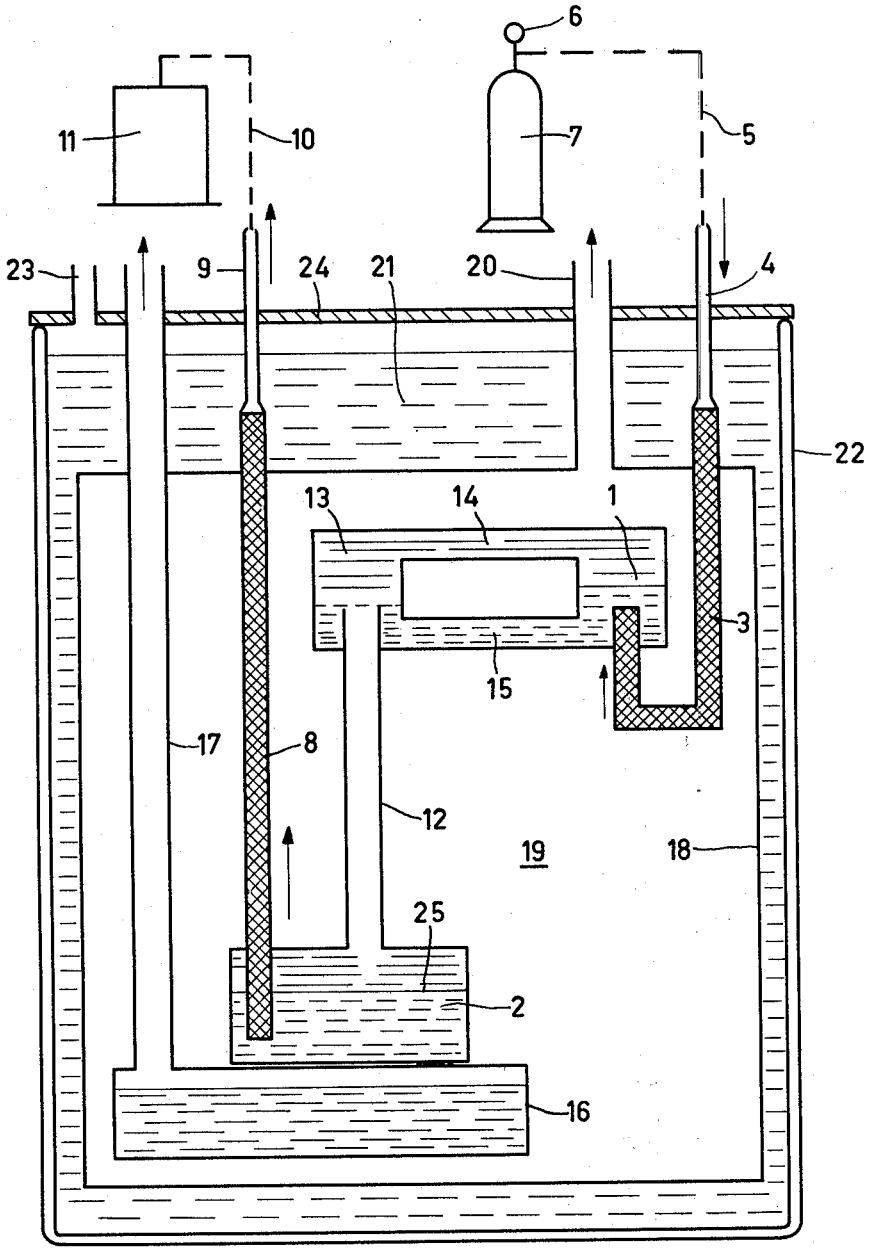
FIG. 1 is a longitudinal sectional view of a $^3He$-$^4He$ dilution refrigerator in which only $^4He$ is circulated by the supply of $^4He$ gas under pressure.

Reference numerals 1 and 2 in FIG. 1 denote two chambers which are accommodated at different levels. The upper chamber 1 is a mixing chamber and the lower chamber 2 is a segregating chamber. A superleak 3 opens into the mixing chamber 1 and has its upper end connected to a gas bottle 7 containing $^4He$ gas under pressure via a capillary 4, a gas supply duct 5 and a reducing valve 6.

A superleak 8 opens near the bottom into the segregating chamber 2 and has its upper end connected to a $^4He$ gas holder 11 via a capillary 9 and a gas outlet duct 10.

A duct 12 whose upper end opens into an auxiliary chamber 13 is connected to the upper side of segregating chamber 2. The upper part of auxiliary chamber 13 is connected to the upper part of the mixing chamber via a duct 14 for the supply of concentrated $^3He$ to the mixing chamber 1, while the lower part of the mixing chamber 1 communicates, via a duct 15 for the outlet of dilute $^3He$ from the mixing chamber, with the lower part of the auxiliary chamber 13.

The segregating chamber 2 is in a heat-conducting relationship with a reservoir 16 containing liquid $^3He$ which absorbs the thermal energy released in chamber 2 upon segregation. The $^3He$ bath is kept at a temperature of 0.3 to 0.6 K. by exhausting $^3He$ vapour via a duct 17.

The part of the refrigerator which is colder in operation is accommodated in a vacuum jacket 18. The space 19 within said jacket is evacuated via a duct 20.

The vacuum jacket 18 is surrounded by a liquid $^4He$ bath 21 at, for example, 1.3 K. in a cryostat 22. Exhaustion of $^4He$ vapour occurs via a duct 23 which is passed through lid 24.

The operation of the device is as follows. Mixing chamber 1, duct 12, auxiliary chamber 13 and segregating chamber 2 are filled with a $^3He$-$^4He$ mixture in such a ratio of the components $^3He$-$^4He$ that upon cooling the segregating chamber 2 by the $^3He$ bath in reservoir 16 (down to a temperature of, for example, 0.3 K.) phase separation (interface 25) in the segregating chamber 2 occurs. As a result of the difference in density between the two phases (concentrated $^3He$ has a lower specific gravity than dilute $^3He$) the connection duct 12 and the mixing chamber 1 are filled automatically with concentrated $^3He$. After the superleaks 3 and 8 have been filled with $^4He$, the circulation is started by the supply of $^4He$ gas from the gas bottle 7. The $^4He$ gas is brought, for example, to a pressure of 2 bar in reducing valve 6.

The $^4He$ gas condenses and becomes superfluid in capillary 4 by the cooling of the $^4He$ bath of 1.3 K. The superfluid $^4He$ passes through the superleak 3, enters the mixing chamber 1 and dilutes concentrated $^3He$ present there. This is associated with production of cold. The dilute $^3He$ which is formed in the mixing chamber 1 and which is specifically heavier than the concentrated $^3He$ flows through outlet duct 15 to connection duct 12 and falls through said connection duct to the segregating chamber 2. Segregation occurs at the interface 25, the superfluid $^4He$ flowing to capillary 9 via superleak 8 and arriving in the gas holder 11 via duct 10 in the gaseous phase. The heat released upon segregation is absorbed by the $^3He$ bath in reservoir 16. During the segregation, concentrated $^3He$ is produced, which results in a flow of concentrated $^3He$ from the segregating chamber 2 via duct 12 and supply duct 14 to the mixing chamber 1. The deficiency of concentrated $^3He$ resulting from the dilution in the mixing chamber 1 is thus replenished. The fact that the concentrated $^3He$ flows through supply duct 14 is, of course, the result of its being lighter, that is, it has a lower specific gravity than dilute $^3He$ and hence it floats on the dilute phase. In normal operation the mixing chamber 1 has, for example, an operating temperature of 8 mK and the auxiliary chamber 13, for example, an operating temperature of 20 mK.

Figure 2:
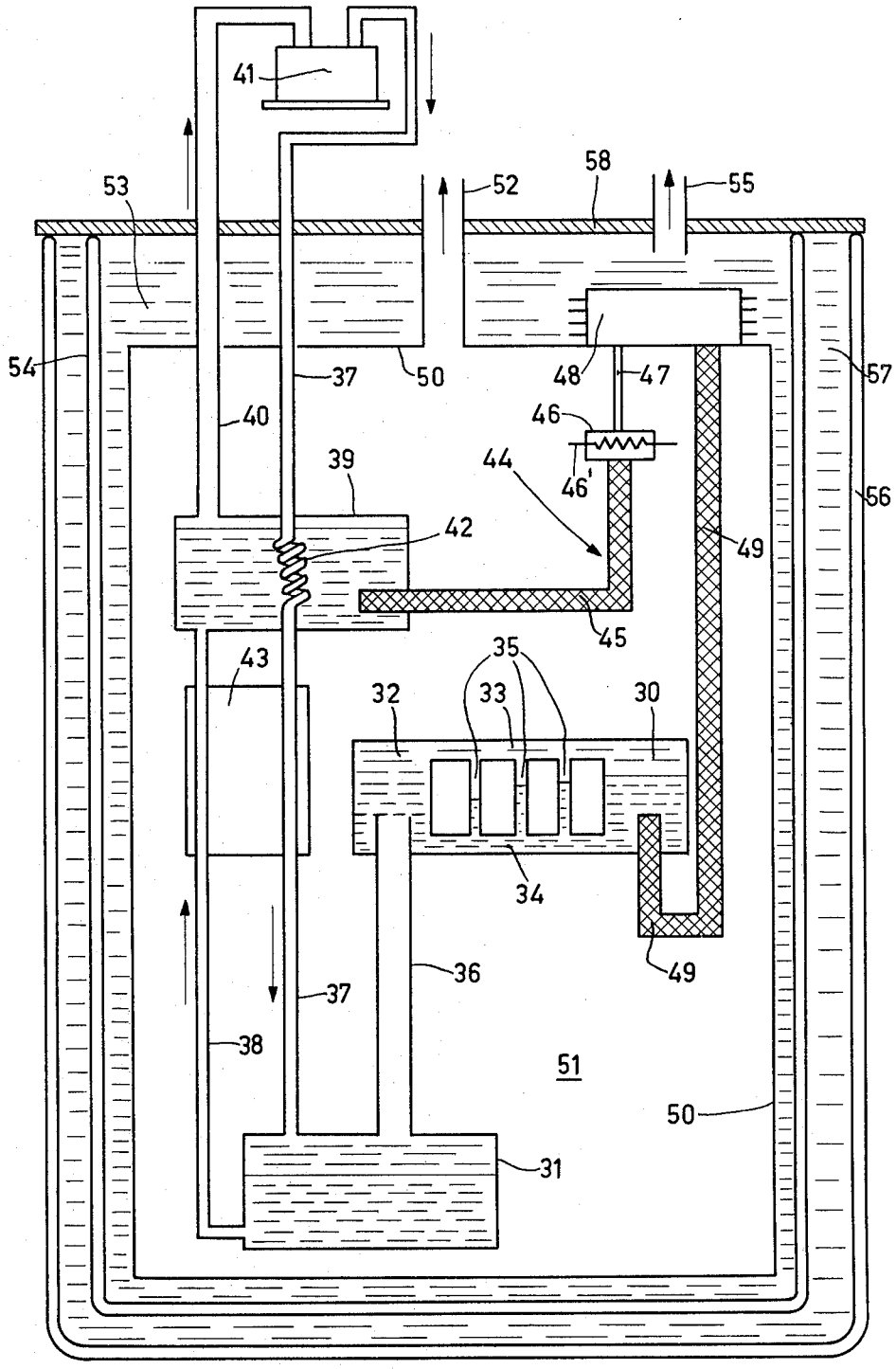
FIG. 2 is a longitudinal sectional view of a $^3He$-$^4He$ dilution refrigerator in which $^4He$ is circulated by a fountain pump and $^3He$ by a mechanical pump.

Reference numeral 30 in FIG. 2 denotes an upper mixing chamber and reference numeral 31 denotes a lower mixing chamber. An auxiliary chamber 32 communicates with the upper part of the upper mixing chamber 30 via a duct 33 for the supply of concentrated $^3He$ to upper mixing chamber 30. The lower part of upper mixing chamber 30 communicates, via a duct 34 for the outlet of dilute $^3He$ from said upper mixing chamber 30, with the lower part of the auxiliary chamber 32. Between the supply duct 33 and the outlet duct 34 are present connection ducts 35 in which dilute $^3He$ and concentrated $^3He$ can exchange heat in direct contact with each other.

A duct 36 opens into auxiliary chamber 32 and has its other end opening into the lower mixing chamber 31. Furthermore connected to lower mixing chamber 31 are a supply duct 37 for concentrated $^3He$ and a communication duct 38 which is connected to an evaporation reservoir 39 having an outlet 40 for gaseous $^3He$. A pumping system 41 is connected on its suction side with the outlet 40 and on its compression side with the supply duct 37. Supply duct 37 has a heat exchanger 42 accommodated in the evaporation reservoir 39. Supply duct 37 and connecting duct 38 are in heat exchanging contact with each other via a heat exchanger 43.

A $^4He$ fountain pump 44 is present between evaporation reservoir 39 and upper mixing chamber 30 and comprises the following components: a superleak 45 opening into the evaporation reservoir 39, a space 46 having a heating device 46', a capillary 47, a cooler 48, and a superleak 49 opening into the upper mixing chamber 30.

The part of the refrigerator which is colder in operation is accommodated in a vacuum jacket 50. The space 51 within the jacket 50 can be evacuated via a duct 52. The vacuum jacket 50 and the cooler 48 are cooled by a $^4He$ bath 53 at, for example 1 K. in a cryostat 54. $^4He$ vapour is exhausted via a duct 55. The $^4He$ cryostat 54 is accommodated in a cryostat 56 filled with liquid nitrogen 57 (78 K.) and having a lid 58.

The operation of the refrigerator is as follows. The device is filled with a liquid helium mixture in such a ratio of the components $^3He$ and $^4He$ that upon cooling the lower mixing chamber 31 phase separation occurs in said lower mixing chamber 31. As a result of the difference in density between the two phases (concentrated $^3He$ and dilute $^3He$) the duct 36, the auxiliary chamber 32 and the upper mixing chamber 30 are then filled automatically with concentrated $^3He$.

In normal operation substantially pure $^3He$ in the liquid phase is supplied via supply duct 37 to lower mixing chamber 31 where the supplied $^3He$-rich phase changes into the $^3He$-poor phase. This is associated with a cooling effect and generation of cold. The $^3He$ then flows through the connection duct 38 to the evaporation reservoir 39. Via gas outlet 40, mainly $^3He$ which is more volatile than $^4He$, is drawn in by the pumping device 41 and passed into the supply duct 37. Condensation and further cooling of the $^3He$ take place by heat exchange with successively the $N_2$ bath 57, the $^4He$ bath 53, the liquid $^3He$-$^4He$ mixture in evaporation reservoir 39 via heat exchanger 42 and by counter-current heat exchange in the exchanger 43.

In addition, since a slightly higher temperature is provided in space 46 than in reservoir 39 by means of heating device 46' superfluid $^4He$ is transported from reservoir 39 through superleak 45 to space 46 due to the occurring fountain pump effect. An additional advantage is that this withdrawal of $^4He$ is associated with heat evolution in reservoir 39 so that the evaporation of $^3He$ can take place without additional heating. Said $^4He$ flows from space 46 via duct 47 and cooler 48 to the inlet of superleak 49. In cooler 48 the superfluid $^4He$ delivers heat to the $^4He$ bath 53.

By the series arrangement of superleak 45, space 46, duct 47 and cooler 48, such a force is exerted on said $^4He$ that a high pressure is obtained at the inlet of superleak 49. This high pressure causes superfluid $^4He$ to flow through superleak 49 against a temperature gradient to upper mixing chamber 30 and to be injected thereinto. In upper mixing chamber 30, concentrated $^3He$ dissolves in the locally injected $^4He$, cold being generated. The formed dilute $^3He$ which has a higher specific gravity than concentrated $^3He$ falls and via outlet duct 34 flows to duct 36. In duct 36 the dilute $^3He$ drops through concentrated $^3He$ to the dilute phase at the bottom of lower mixing chamber 31 and is dissipated via duct 38 to evaporation reservoir 39. The deficiency of concentrated $^3He$ arising in upper mixing chamber 30 as a result of the dilution is eliminated by replenishing the concentrated $^3He$ which flows from the lower mixing chamber 31 via duct 36, auxiliary chamber 32 and inlet duct 33 to upper mixing chamber 30. In the connection ducts 35 this concentrated $^3He$ is precooled by dilute $^3He$ which in outlet duct 34 is on its way to duct 36.

In the present refrigerator, production of cold takes place at two levels, namely in the upper mixing chamber 30 at a temperature of, for example 2 to 5 mK and in the lower mixing chamber 31 at a temperature of 20–100 mK. The auxiliary chamber 32 has a temperature of 4 to 15 mK while a temperature of 9.7 to 0.9 K. prevails in the evaporation chamber 39.

What is claimed is:

1. A $^3He$-$^4He$ dilution refrigerator for producing very low temperatures, which comprises two chambers respectively situated at different levels, the upper chamber forming a mixing chamber for mixing liquid concentrated $^3He$ and superfluid $^4He$ and the lower chamber forming a segregating chamber for separating concentrated $^3He$ and superfluid $^4He$; a superleak opening into the mixing chamber for supplying superfluid $^4He$ to the mixing chamber; a connection duct having a lower end opening near the top of the segregating chamber; an auxiliary chamber, the upper end of the connecting duct opening thereinto; a supply duct between the upper part of the auxiliary chamber and the upper part of the mixing chamber for flow of concentrated $^3He$ to the upper part of the mixing chamber; and an outlet duct between the lower part of the mixing chamber and the lower part of the auxiliary chamber for flow of dilute $^3He$ to the lower part of the auxiliary chamber.

2. A $^3He$-$^4He$ dilution refrigerator according to claim 1, which includes one or more heat exchangers between the supply duct and the outlet duct for heat exchange between the concentrated $^3He$ and the dilute $^3He$.

3. A $^3He$-$^4He$ dilution refrigerator according to claim 2, in which the one or more heat exchangers are formed by connection ducts for direct heat exchange between the concentrated $^3He$ and the dilute $^3He$.

* * * * *